United States Patent [19]

Gardner

[11] 4,077,561

[45] Mar. 7, 1978

[54] PARTITION ARRANGEMENT

[75] Inventor: Jeffrey M. Gardner, Wheaton, Ill.

[73] Assignee: Container Corporation of America, Chicago, Ill.

[21] Appl. No.: 817,368

[22] Filed: Jul. 20, 1977

[51] Int. Cl.[2] ..... B65D 5/48; B65D 25/04

[52] U.S. Cl. ..... 229/42; 229/28 R; 229/15

[58] Field of Search ..... 229/15, 28, 42

[56] References Cited

U.S. PATENT DOCUMENTS

| | | | |
|---|---|---|---|
| 3,640,445 | 2/1972 | Durham | 229/15 |
| 3,738,561 | 6/1973 | Nederveld | 229/15 |
| 3,963,169 | 6/1976 | Gardner | 229/15 |
| 4,030,659 | 6/1977 | Gardner | 229/15 |

*Primary Examiner*—Davis T. Moorhead

*Attorney, Agent, or Firm*—Carpenter & Ostis

[57] ABSTRACT

A paperboard internal partition arrangement formed from a unitary blank of foldable paperboard and including a longitudinal and a transverse partition forming three cells, one of which is normal to the other two cells.

2 Claims, 5 Drawing Figures

PARTITION ARRANGEMENT

SUMMARY OF THE INVENTION

This invention relates to partition arrangements and more particularly to a divider/pad combination formed of paperboard especially suitable for use in supporting plastic bagged items such as marshmallows, candies, noodles and similar items.

An object of the invention is the provision of a three cell paperboard partition arrangement which is self standing upon erection and which is of simple design and economical construction.

A more specific object of the invention is the provision, in a partition arrangement of the type described, of a base pad and a pair of vertical partitions which cooperate to form a three cell divider.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
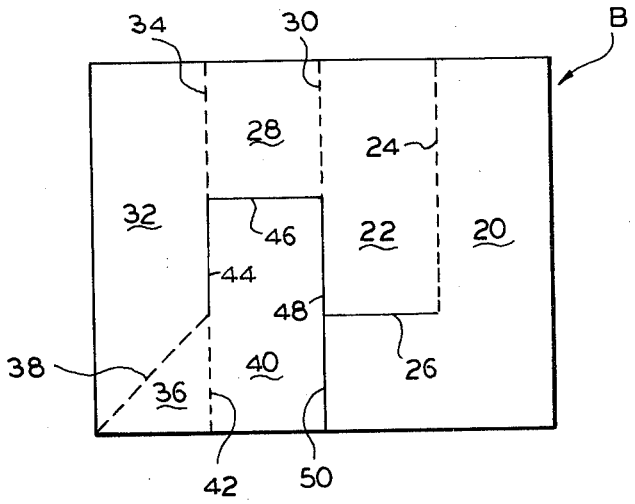
FIG. 1 is a plan view of a blank of sheet material from which the structure illustrated in the other views may be formed.
Figure 2:
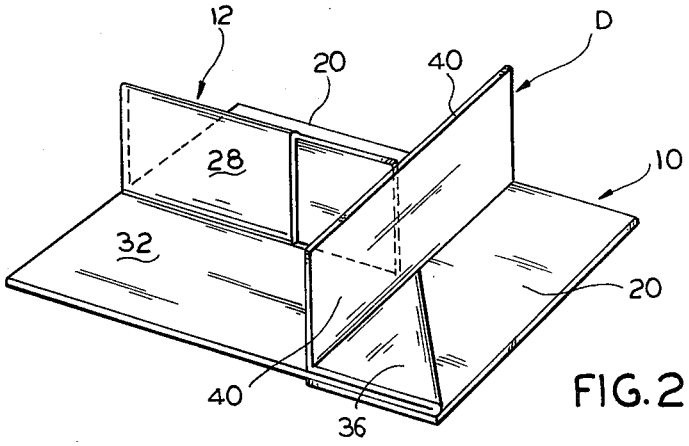
FIG. 2 is a perspective view of a partition arrangement embodying features of the invention.
Figure 3:
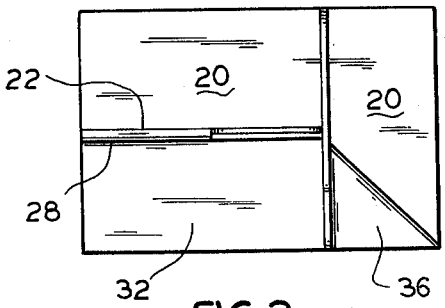
FIG. 3 is a top plan view of the structure illustrated in FIG. 2.
Figure 5:
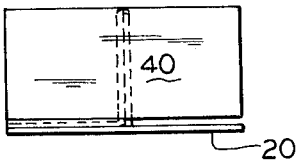
FIG. 5 is an end elevation of the structure illustrated in FIG. 2.
Figure 4:
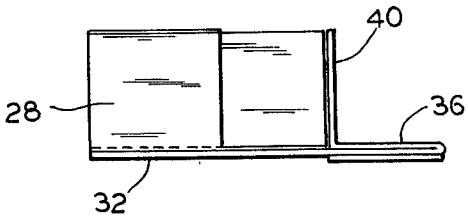
FIG. 4 is a side elevation of the structure illustrated in FIG. 2.

Referring now to the drawings for a better understanding of the invention, it will be seen that the partition or divider indicated generally at D in FIG. 2 may be formed from a unitary blank B of foldable sheet material such as paperboard, as illustrated in FIG. 1.

Basically the partition arrangement or divider D includes a horizontal flat base 10 having upstanding therefrom a longitudinal partition 12 and a transverse partition 40 which are foldably joined to the base 10 in a manner hereinafter described.

As best seen in FIG. 1, blank B is preferably rectangular in shape and includes a generally L shaped first base forming panel 20 at the right hand side of blank as seen in FIG. 1.

A generally rectangular, first longitudinal partition forming panel 2 is foldably joined to an inner side edge of panel 20 along a fold line 24 and is separated at its end from another inner edge of base 20 by a cut line 26 which extends in a direction normal to fold line 24.

It will be seen that first longitudinal partition forming panel 22 and first base forming panel 20 fit together so as to form a rectangular area which is equal to one half of the overall area of blank B.

A generally rectangular second longitudinal partition forming panel 28 is foldably joined at one side edge along fold line 30 to the adjacent edge of first longitudinal partition forming panel 22.

A second base forming panel 32 which is generally trapezoidal in shape is foldably joined at one side edge along fold line 34 to an adjacent side edge of second longitudinal partition forming panel 28. It will be noted that first, second and third fold lines 24, 30 and 34 respectively, are parallel to each other.

A generally triangular gusset forming panel 36 is foldably joined along a diagonal inner edge on fold line 38 to an adjacent edge of second base forming panel 32.

The last portion of the structure is a transverse partition forming panel 40 which is foldably joined along one edge on fold line 42 to an adjacent edge of gusset forming panel 36. It will be noted that fold line 42 is spaced from and in alignment with fold line 34 and also that fold line 42 forms an angle of less than 90° with fold line 38.

The other edges of transverse partition forming panel 40 are spaced from second base forming panel 32, second longitudinal forming panel 28, first longitudinal partition forming panel 22, and first base forming panel 20, by cut lines 44, 46, 48 and 50, respectively.

Cut line 44 is aligned with fold lines 34 and 42, cut lines 48 and 50 are in alignment with each other and with fold line 30, and cut line 46 extends in a direction normal to and between the inner ends of cut lines 44 and 48.

When the device is in erected condition as shown in FIG. 2, first and second longitudinal partition forming panels 24 and 28 are arranged in a vertical position in face to face relation, and transverse partition forming panel 40 is also in a vertical position extending in a direction normal to the longitudinal partition 12 at one end thereof to divide the carton into three cells, one of which is at right angle to the other two. Gusset 36 which connects the transverse partition forming panel 40 to the second base forming panel 32 is folded to lie on top of the second base forming panel 32, the end portion of which is disposed to lie on top of adjacent portion of first base forming panel 20.

Thus, it will be seen that the invention provides a self contained partition arrangement of simple design and construction which can be used within a box or outer wrapping to form a plurality of cells.

I claim:

1. A self-contained partition arrangement, formed from a rectangular unitary blank of foldable paperboard, for providing three cells with one cell disposed normal to the other two cells, comprising:

(a) a base member including a pair of substantially coplanar sections;

(b) one of said sections being generally L-shaped and having first and second portions extending normal to each other;

(c) the other of said sections extending parallel to the first portion of said one section and having an end area in lapped relation with a free end area of the second portion of said one section;

(d) a first partition member including a pair of partition panels disposed in face-to-face relation with upper edges foldably joined to each other and with lower edges foldably joined to adjacent inboard edges of said other section and the first portion of said one section, respectively;

(e) a second partition member including a partition element extending normal to said first partition member and a triangular gusset element foldably joined at one edge to a lower edge of said partition element and having another edge foldably joined to an angular edge of said other section.

2. A generally rectangular, unitary blank of foldable paperboard for forming a three cell partition arrangement having a base, a longitudinal partition, and a transverse partition at one end of said longitudinal partition, said blank being divided by a plurality of cut and fold lines into:

(a) a generally L-shaped first base forming panel;

(b) a generally rectangular, first longitudinal partition forming panel foldably joined along one edge to an edge of said first base forming panel on a first fold line;

(c) a generally rectangular second longitudinal partition forming panel foldably joined at one side edge to an opposite side of said first longitudinal partition forming panel along a second fold line parallel to said first fold line;

(d) a generally trapezoidal second base forming panel foldably joined at one side edge to an opposite side edge of said second longitudinal partition forming panel along a third fold line parallel to said first and second fold lines;

(e) a generally triangular gusset forming panel foldably joined at one edge to an end edge of said second base forming panel along a fourth fold line which extends at an angle of less than ninety degrees with respect to said first, second, and third fold lines;

(f) a generally rectangular transverse partition forming panel foldably joined along one edge to an adjacent edge of said gusset forming panel along a fifth fold line which is spaced from but aligned with said third fold line.

* * * * *